US005671667A

United States Patent [19]

Simmet

[11] Patent Number: 5,671,667

[45] Date of Patent: Sep. 30, 1997

[54] MULTI-LINE STRAW PRINTER

[75] Inventor: Ludwig O. Simmet, Madison, Wis.

[73] Assignee: Minitube of America, Inc., Verona, Wis.

[21] Appl. No.: 630,496

[22] Filed: Apr. 10, 1996

[51] Int. Cl.[6] ..... B41F 17/20

[52] U.S. Cl. ..... 101/35; 101/36

[58] Field of Search ..... 101/35, 36, 37

[56] References Cited

U.S. PATENT DOCUMENTS

| | | | |
|---|---|---|---|
| 5,160,940 | 11/1992 | Cassou et al. | 346/75 |
| 5,289,767 | 3/1994 | Montalto et al. | 101/35 |
| 5,444,466 | 8/1995 | Smyczek et al. | 101/35 |
| 5,558,449 | 9/1996 | Morgavi | 400/188 |

FOREIGN PATENT DOCUMENTS

| | | | |
|---|---|---|---|
| 234978 | 1/1987 | France | 101/35 |
| 847042 | 9/1960 | United Kingdom | 101/35 |

OTHER PUBLICATIONS

"Artificial Insemination," pp. 16–19, Minitübe of America, Inc.

*Primary Examiner*—Edgar S. Burr
*Assistant Examiner*—Daniel J. Colilla
*Attorney, Agent, or Firm*—Lathrop & Clark

[57] ABSTRACT

Two opposed inkjet print heads direct ink droplets to opposite sides of a cylindrical elongated plastic straw containing biological products such as semen or ova. The print heads are controlled by a computer to print multiple lines of text or data as the straw is advanced by dual parallel drive belts through a bridge which has an straw-directing infeed channel. The straw is discharged from the channel through an unobstructed window in the bridge which is positioned in the path of the two print heads. Downstream of the window the straw passes over portions of the bridge which form a shelf with open sides, on which the straw is supported until it is engaged by the outfeed portions of the dual belts which remove the printed straw from the bridge. The construction of the bridge ensures accurate positioning of the straw, while minimizing disturbances to the freshly applied ink.

25 Claims, 3 Drawing Sheets

MULTI-LINE STRAW PRINTER

FIELD OF THE INVENTION

The present invention relates to devices for handling and treating straws containing biological products in general, and to devices for printing on such straws with multiple print lines in particular.

BACKGROUND OF THE INVENTION

Biological products such as ova and semen are packaged transported and stored in narrow diameter plastic straws which permit quantifies of these valuable commodities to be inventoried and dispensed in an accurate and controlled manner. Straws containing biological products are filled at many diverse locations, and are globally distributed. Because of the disparity in genetic attributes of each biological product, it is essential that the straws be marked in a permanent and legible manner. Particularly in the field of agricultural livestock development, where the pedigree and qualities of the biological products are of key concern, each straw must be identified as to its source location and animal.

Printing on the cylindrical, somewhat resilient straws presents obvious difficulties. The task is unsuited for most types of impact printing, not only because of the non-planar surfaces to be imprinted, but also because the empty or fluid-filled plastic straws will yield or deform if subjected to localized pressure. Initially straws were printed in short runs by resilient rubber inked stamps. However, these mechanical type imprinters had the drawback that the rubber stamp characters would have to be manually changed for each different impression, making it a time-consuming process to individually mark each straw. In addition, operation of this type of machine can be awkward, and requires care that the straws are not crushed. Furthermore, the inked surfaces of the stamps require cleaning.

With the development of the microcomputer, more advanced and electronically controlled devices became available for printing on straws. Currently, straws are primarily marked by computer controlled ink-jet printers, which utilize a single print head which dispenses a stream of tiny ionized ink droplets which are electromagnetically directed as they leave the print head to describe characters on the straw surface. The characters are comprised of an array of dots, and may thus be fully controlled as to size, line thickness and spacing. To accurately and rapidly mark the straws, a mechanism must be provided for positioning the straw with respect to the print head, and then advancing the straw with respect to the print head to receive a full line of text. One way of achieving this position control of the straw is by supporting it over its full length of travel on one or more rubber belts. An example of an effective machine for performing this process is the MINIJET inkjet printer, manufactured by Minitüb Gmbh of Tiefenbach, Germany.

Biological product straws are typically of very narrow diameter, ranging from 2 mm to 5 mm, and usually about 133 mm or 280 mm long. Hence the quantity of legible text which can be imprinted in a single line on a straw is limited. Furthermore, due to international trade requirements, there is an increasing need to print additional information on individual straws. A single print head is limited to coverage of one half the surface of the straw.

What is needed is a machine which would permit printing over the entire surface of the straw. Such a machine would permit more detailed information in a readily readable form to be imprinted on each straw, thereby facilitating rapid handling and rapid assessment of the contents of each straw.

SUMMARY OF THE INVENTION

The biological product straw printer of this invention utlizes two inkjet print heads which direct trajectory-controlled ink droplets on to opposite sides of a cylindrical elongated plastic straw. The print heads are positioned around the circumference of the straw or opposed. The print heads are controlled by a computer to print multiple lines of text or data as the straw is advanced at a controlled rate by dual parallel drive belts through a straw support bridge. The support bridge has a square channel which receives a straw from the infeed portion of the drive belts. The straw is discharged from the square channel through an unobstructed window in the bridge which is positioned in the path of the two print heads. Downstream of the window the straw passes over portions of the bridge which form a shelf with open sides, on which the straw is supported until it is engaged by the outfeed portions of the dual belts which remove the printed straw from the bridge. An optical sensor detects the entry of the straw into the bridge, and printing is initiated in response to signals from the sensor. The construction of the bridge ensures accurate positioning of the straw, while minimizing disturbances to the freshly applied ink. By printing on both sides of a cylindrical straw, the device provides better identification of the biological products such as animal ova and semen contained therein.

It is a feature of the present invention to provide a device for printing multiple lines of data on a straw.

It is a further feature of the present invention to provide a printer which prints on at least two sides of a cylindrical straw.

It is an additional object of the present invention to provide a printer which automatically prints information on straws dispensed from a hopper.

It is another feature of the present invention to provide a multi-line straw printer which may be rapidly converted for printing on cylindrical straws of different diameters.

Further objects, features and advantages of the invention will be apparent from the following detailed description when taken in conjunction with the accompanying drawings.

DESCRIPTION OF THE PREFERRED EMBODIMENT

Figure 1:
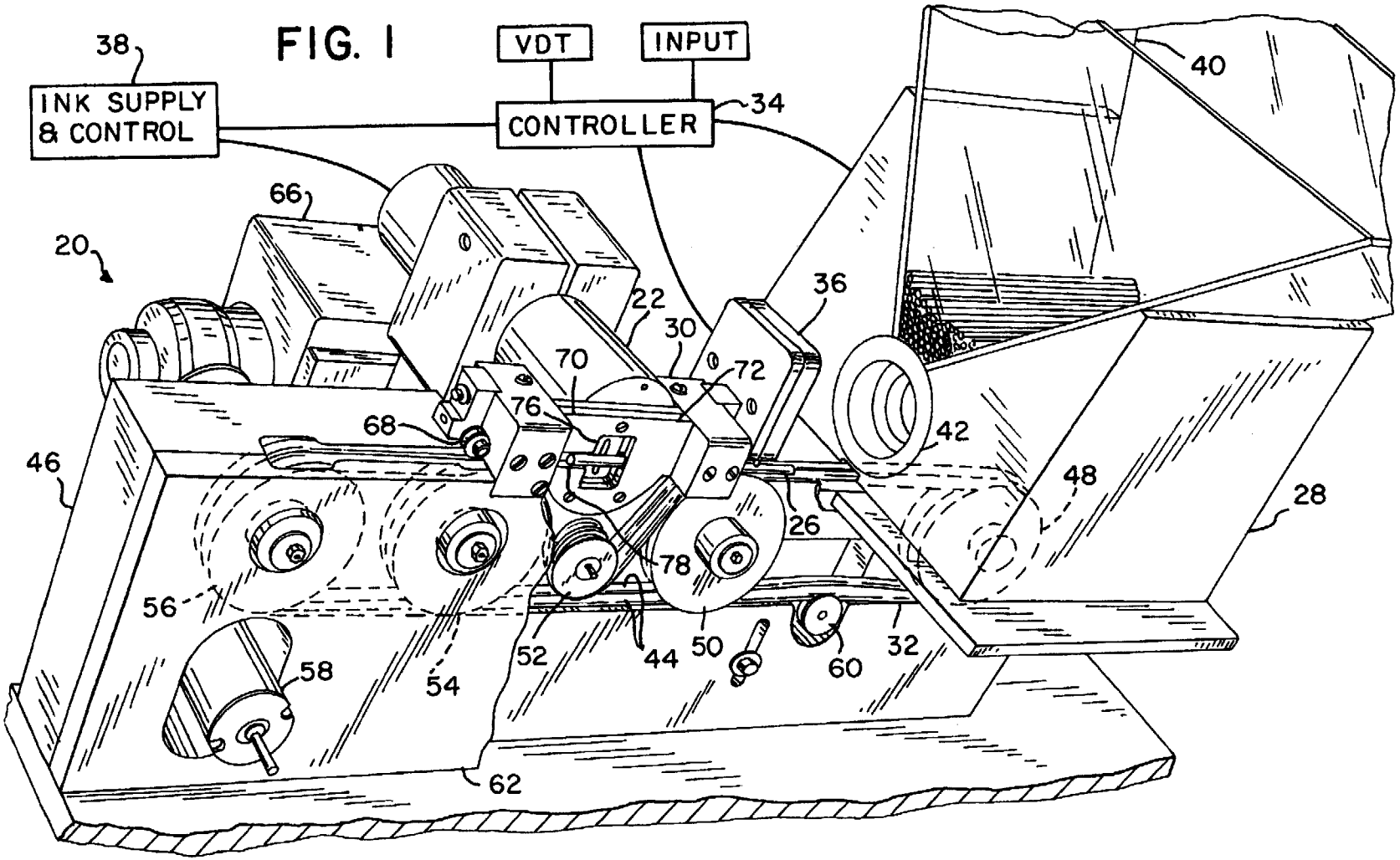
FIG. 1 is an isometric view, partially broken away in section, of the multiline straw printer of this invention, with control, display, and input elements shown schematically.

Referring more particularly to FIGS. 1–4, a multi-line straw printer 20 is shown in FIG. 1. The printer 20 utilizes two inkjet print heads 22, 24 to apply printed matter to both sides of a cylindrical plastic straw 26 which is discharged from a hopper 28 and advanced through a straw support bridge 30 by a dual belt drive system 32. The printing operation takes place under the control of an electronic computer or controller 34 which receives straw position information from a photoelectric detector or sensor 36 and which sends instructions to the inkjet print head ink supply and control units 38. The sensor may be a photocell of the infrared type such as manufactured by Wenglor as model No. UF66VCFS264.

Animal semen and ova are collected by numerous breeder operations around the world. Extensive genetic testing often goes into the production of these biological products from animal stock possessing the most desireable traits for a particular species and husbandry application. For example, cows which have high rates of milk production. Because of the great richness and variety of the available genetic material, each animal will have particular genetic characteristics usually traceable to its ancestors. To accurately track ancestry and genetic history, the collected semen and ova must be marked or labelled at the collection site.

The collected semen and ova have a high value per unit volume, yet are subject to quality loss and fertility decline when exposed to inhospitable atmospheric conditions. Storage at cryogenic temperatures has been found to suitably preserve the collected specimens. Packaging of quantities of semen, and individual ova in elongated plastic straws has become nearly universal. These straws are typically formed of extruded polyvinylchloride (PVC) and sealed ultrasonically at one or both ends or blocked by a wad of cotton, collagen, and a glass or metal ball press-fit into the tube opening.

The straws are available in a number of sizes, usually denoted by the volume contained. Common sizes are 0.25 ml, 0.5 ml, and 5 ml, each straw being about 133–280 mm long, and 2 mm or 5 mm in diameter. The straws will be loaded with the biological product prior to or after reaching the straw printer 20, either at a separate location, or at stations upstream of the printer. As shown in FIG. 1, a quantity of straws 26 are loaded into the hopper 28 in parallel alignment, with the long axes of the straws being aligned with the dual belt drive 32. The hopper 28 has a V-shaped trough 40 with a rotating drum 42 positioned at the base of the trough. The drum 42 has a series of parallel grooves which receive single straws from the trough 40. The drum 42 is rotated under the control of the controller 34 to deliver individual straws to the moving dual belt drive 32 which runs beneath the hopper 28. Alternatively, a hopper system without a rotating drum, having an agitating bottom plate with an opening suitable for each size object could also be employed.

The drive system consists of two circular cross-section flexible belts 44 which are a nominal 3/16 inches in diameter and which are spaced from one another approximately 0.227 inches center to center. The two belts provide a means for supporting and advancing the straws through the printer. An exemplary belt is formed of neoprene or Buna-N or similar material. The straw printer 20 has a rigid housing 46, preferably formed of an easily cleaned material, such as stainless steel. Each belt 44 is a continuous loop which is stretched to travel over rotatable pulleys 48, 50, 52, 54, 56 which are mounted to the housing 46. Each pulley has two spaced grooves which support the two belts 44. The belts 44 travel from a first infeed pulley 48 located beneath the hopper 28 to a second infeed pulley 50 located upstream of the support bridge 30. The belts 44 are then directed away from the support bridge 30 around a smaller diameter relief pulley 52, and are returned to contact with the straws at a first outfeed pulley 54. The belts 44 then turn around a second outfeed pulley 56 and are returned to the first infeed pulley 48. In a preferred embodiment the second outfeed pulley 56 is driven by an electric motor 58, shown in FIG. 2. The tension applied overall to the belts 44 may be adjusted by a tension pulley 60, shown in FIG. 1, which engages beneath the belts as they return to the first infeed pulley 48 from the second outfeed pulley 56. The tension pulley 60 is mounted on a block which is vertically adjustable by a screw to increase or decrease the tension on the belts 44.

The housing 46 is formed with semi-cylindrical upwardly opening channels along the straight potions of the belt in between the first infeed pulley and the second infeed pulley and between the first outfeed pulley and the second outfeed pulley. One of the belts 44 is thus supported in these channels for horizontal advancement of the supported straw. A face plate 62 is screwed to the housing 46 to cover the rotating pulleys and most portions of the belt. The face plate 62 also has portions defining a semicylindrical channel to support the second belt 44.

A straw 26 deposited by the hopper 28 on the parallel belts 44 progresses downstream to the support bridge 30. The photoelectric detector 36 is mounted to the housing 46 above the parallel belts 44 ahead of the bridge 30. The detector 36 includes a fiber optic coupling, such that the detector electronics may be placed away from the actual path of the straw. Various detectors may be employed, for example an infrared retroreflective type detector. The detector 36 sends a signal to the controller 34 when a straw 26 first crosses the detector's path. With information on the position of the straw, the controller 34 can instruct the print heads 22, 24 to start printing at the appropriate time to position the legend on the straw in the proper location.

The print heads 22, 24 may be conventional inkjet print heads, for example those manufactured by Willett America Inc., of Ft. Worth, Tex., as model 3820 or those manufactured by Linx Printing Technologies Plc, Burrel Road, St. Ives, Cambridgeshire, UK, as model 6000 or similar units. Each print head is supplied with a stream of ink droplets by a conventional inkjet supply and control unit 38 which includes a pump, ink and solvent reservoirs, and relevant print head electronic controls.

Figure 2:
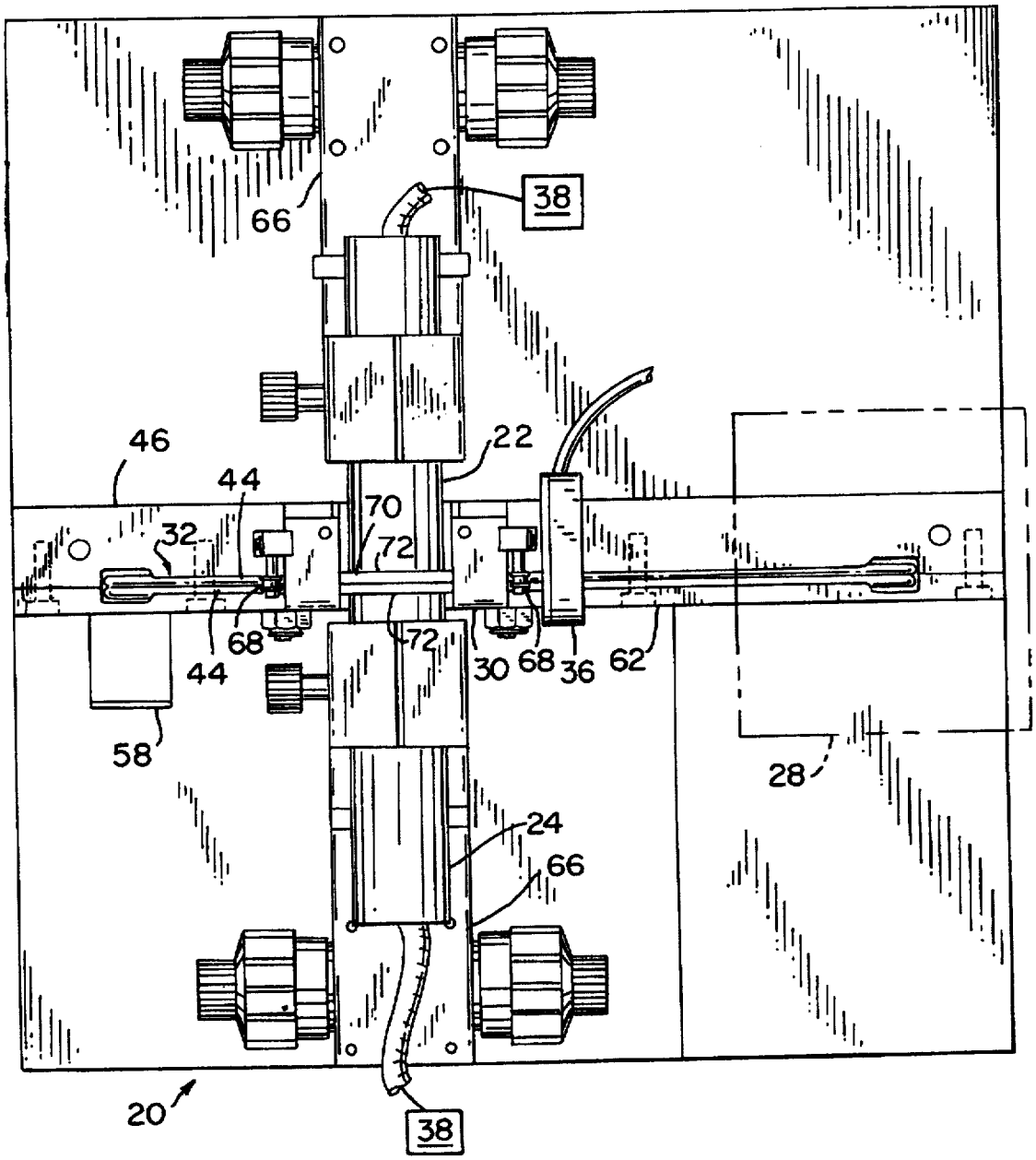
FIG. 2 is a top plan view of the apparatus of FIG. 1.

As shown in FIG. 2, the print heads 22, 24 are mounted in adjustable stages 66 which permit the accurate vertical and horizontal positioning of the print heads to direct a stream of ink droplets onto a straw 26 supported in the bridge 30. Because the printer 20 is adapted for use with straws of different diameter, it may be necessary to adjust the print heads vertically and/or horizontally with a change in straw diameter. One print head 22 is positioned rearward of the bridge 30, and the other print head 24 is positioned forward of the bridge 30. The print heads are noncontact printers, and thus form an image on the straw without coming into direct contact with the straw. Droplets of ink are ejected from the print head to come in contact with the straw as it is conveyed by the dual belt drive system. The controller 34 sends instructions to the print heads 22, 24 to form the letters and symbols of the two lines of printing on the straw. In most cases it will be desireable that both lines of text are readable from left to right, without the need to invert the straw. Hence, one of the print heads prints the characters "upside down" when compared to the printing from the other head, so that the two lines of printing may be read by simply rotating the straw.

To provide for printing over the greatest portion of the surface of the straw, the straw should be unsupported at the point where it is subjected to the ink droplet spray from the print heads. Furthermore, because the ink is a liquid, which requires a finite, although small, time to dry, it is desireable that contact with the printed surfaces of the straw be avoided immediately after printing. The straw support bridge 30 provides both of these functions.

Figure 3:
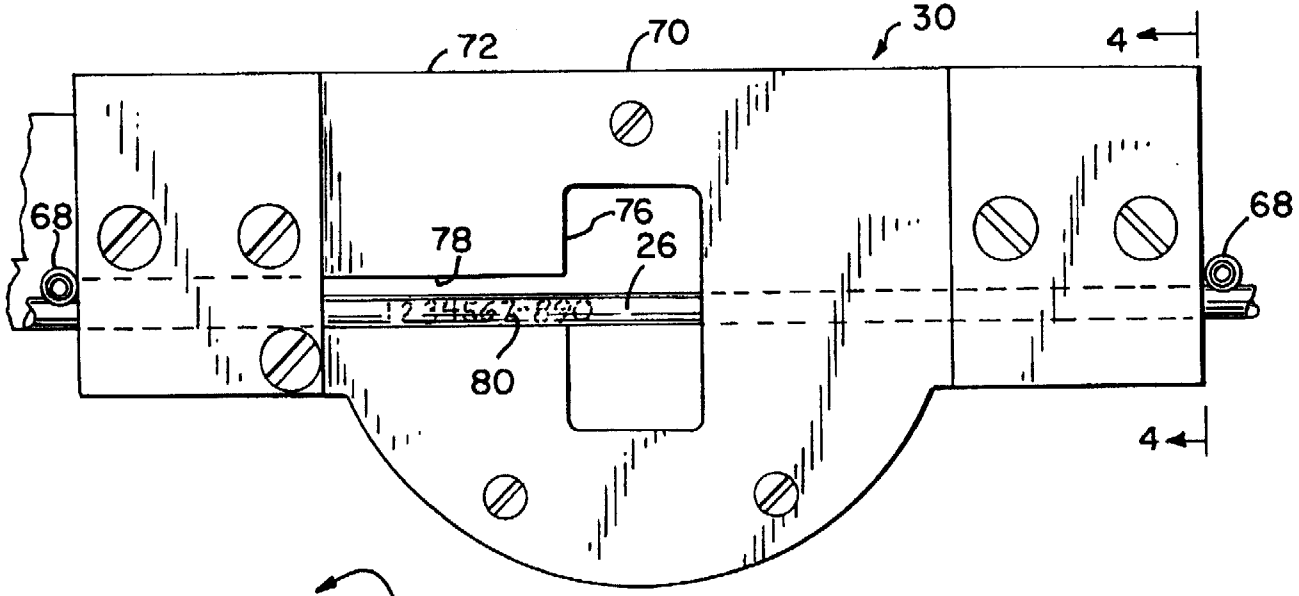
FIG. 3 is a front elevational view of the straw printing support bridge of the device of FIG. 1.
Figure 4:
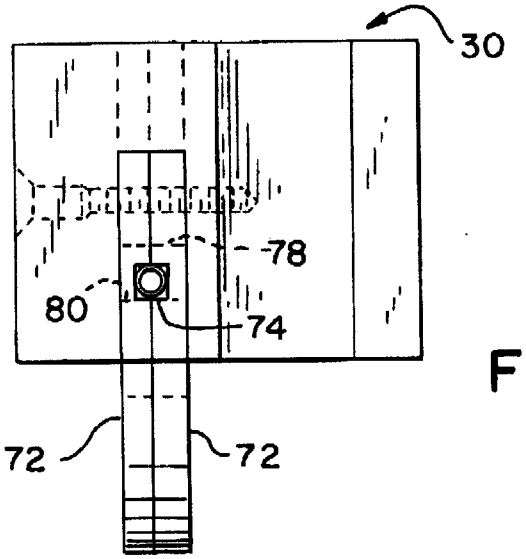
FIG. 4 is a side elevational view of the bridge of FIG. 3 taken at the inlet end of the bridge along line 4—4.

Rollers 68 are mounted to the support bridge 30 at the inlet to the bridge and at the outlet from the bridge. The rollers 68 are steel rollers with a V-groove formed therein. The rollers serve to retain the straw along its horizontal path as it enters the bridge and the drive belts curve away from the straw path. As shown in FIGS. 3 and 4, the bridge 30 has a central section 70 which may be a solid steel member, but which for reduced manufacturing costs may be formed of two plates 72. Each plate 72 has a square channel milled in it, so that when the two plates are joined together an enclosed square inlet tunnel 74 is defined. The inlet tunnel 74 is only slightly larger than the diameter of the straw 26 to be printed on, and thus controls the progress of the straw through the bridge where the straw is no longer supported directly on the belts 44. The inlet tunnel 74 discharges into a rectangular cut out window 76 in the central section 70. The window 76 is positioned at the location of the print heads 22, 24, and provides completely unobstructed access to the straw on both sides. Downstream of the window 76, a slot 78 is cut through both plates 72 of the central section 70. The slot has a support surface 80 which is at the same level as the base of the inlet tunnel 74. However the slot is fully open sidewardly, and is taller than the inlet tunnel 74. Hence the printed straw 26 only engages the bridge 30 along one unprinted surface, minimizing contact with the newly applied ink.

Preferably, the print heads are positioned with respect to the window 76, and the initiation of printing is timed, such that the straw is at least resting on the support surface 80 when printing begins. At the beginning of the printing process, the straw is driven at a constant rate past the print heads 22, 24 by the infeed section of the drive belts 44. Eventually, the straw will be fully driven into the bridge 30, and will no longer be in engagement with the infeed section of the drive belts. By that time, however, the straw 26 will have passed through the bridge 30 sufficiently to be engaged by the outfeed section of the drive belts 44, and will continue to be pulled from the bridge. The straws printed on the printer 20 will thus be longer than the width of the bridge 30, so that the straw may be continuously driven throughout.

The printer 20 offers numerous advantages over single line straw printing systems. For example, information may be printed in two different languages, and letters, figures, and barcodes may be mixed. In addition to the standard identification information which must be provided on a straw, detailed corporate or identification information may be provided as well as instructions for use. Furthermore, magnetic inks may be employed for use with magnetic readers. To assist the user in entering this information, the controller 34 is preferably provided with a video display terminal 82 for a display of the proposed printed legend, and a keyboard 84 for input of data and commands. Software is preferably provided for printer control and maintenance of a database of data.

It will often be desired to print first on straws of one diameter, and then on those of another diameter. The printer 20 is adapted for rapid changeover from one size straw to another. The hopper 28 may be pivoted forward and removed from the unit to be replaced with a hopper filled with straws of a different diameter. In addition, the support bridge 30 is formed in a unit to be rapidly unscrewed from the housing 46 and replaced with a support bridge of the same basic configuration, but with an inlet tunnel of different width and height, and with inlet and outlet rollers positioned at a different height. Thus in a matter of minutes the printer 20 can be made ready for printing on straws of a different diameter.

It should be noted that although a single set of belts is used for both infeed and outfeed of the straws in the embodiment illustrated, separate infeed drive and outfeed drive belts could also be employed. In addition separate drive motors could be used to drive the infeed and the outfeed belts. In this way it could be possible to remove the straws from the bridge at a faster rate than they are delivered to the bridge, should it be desireable to increase the spacing between straws.

It should be noted that although the printing of multiple lines on cylindrical straws has been described above, the straw printer may also be configured for printing on non-round straws. Printing on larger straws, for example those that contain 5 ml (typically 280 mm×5 mm), and on plastic goblets or cups for cryogenic storage of various diameters may also be accommodated by appropriate bridge structure. Furthermore, although inkjet print heads have been discussed, other noncontact printers may also be employed. In addition, a single belt having a central groove may be substituted for two parallel cylindrical belts. Although semen and ova have been discussed as being contained within the straws printed upon by the printer of this invention, other fluids or materials may also be enclosed within the straws. In addition, although the infeed channel in the straw support bridge has been discussed as being square and formed by the connecting together of two machined plates, the channel may also be formed of other shapes—for example as a cylindrical opening with three or more inwardly projecting ribs and formed through EDM techniques. Furthermore, the noncontact print heads need not be positioned directly opposite one another, but may be directed downwardly or upwardly as circumstances require—for example for printing on two surfaces of a triangular It is understood that the invention is not limited to the particular construction and arrangement of parts herein illustrated and described, but embraces such modified forms thereof as come within the scope of the following claims.

We claim:

1. A printer for printing multiple lines of markings on a straw for containing biological products, the printer comprising:

a) a housing;

b) a first noncontact print head mounted to the housing;

c) a second noncontact print head mounted to the housing facing toward the first noncontact print head;

d) a belt drive system having two parallel belts which support and advance a straw thereon;

e) a straw support bridge mounted to the housing and which receives a straw from the belt drive system, the belt drive system advancing said straw through the support bridge without contacting said straw within the support bridge;

f) portions of the support bridge defining an unobstructed window positioned between the first print head and the second print head, such that a first line of markings may be imprinted on one side of said straw by the first print head and a second line of markings may be simultaneously imprinted on said straw by the second print head while the straw is advanced by the belt drive system through the support bridge window; and g) portions of the support bridge supporting said straw to align it for passage through the bridge window and deliver it into engagement with the belt drive system after the straw has been imprinted by the first print head and the second print head.

2. The printer of claim 1 wherein the straw support bridge has portions defining an infeed tunnel which is aligned with an infeed portion of the drive system, wherein a straw is driven into the infeed tunnel by the belt drive system, and wherein the straw is discharged from the infeed tunnel into the support bridge window, and wherein the straw is not in contact with any structure where it passes through the support bridge window.

3. The printer of claim 2 further comprising a roller rotatably mounted to the straw support bridge upstream of the infeed tunnel above the belt drive system, wherein the roller is positioned to engage a straw as it is delivered from the belt drive system to the infeed tunnel and to thereby direct the straw into the infeed tunnel.

4. The printer of claim 2 wherein the straw support bridge has portions defining a slot having a horizontal support surface downstream of the window which is aligned with the infeed tunnel, wherein the imprinted straw is supported on the support surface without sideward contact to minimize disturbance of the imprinted straw surfaces within the bridge.

5. The printer of claim 4 further comprising a roller rotatably mounted to the straw support bridge downstream of the slot and above the belt drive system, wherein the roller is positioned to engage a straw as it is delivered from the slot support surface to the belt drive system and to thereby direct the straw onto the parallel belts.

6. The printer of claim 2 wherein the support bridge is comprised of two connected plates, wherein each plate has portions defining a channel therein, such that channels are aligned in the support bridge to form the infeed tunnel.

7. The printer of claim 1 further comprising a straw hopper attached to the housing and disposed above the belt drive system upstream of the support bridge, wherein the hopper contains a plurality of straws, and wherein the hopper is controllable to dispense individual straws onto the belt drive system for printing thereon.

8. The printer of claim 1 further comprising a sensor mounted to the housing upstream of the straw support bridge, wherein the sensor is configured to detect the presence of a straw on the belt drive system.

9. The printer of claim 8 further comprising a controller which receives signals from the sensor indicating the presence of a straw on the belt drive system, wherein the controller sends instructions to the first print head and the second print head to initiate printing at a selected time such that the straw which has been detected by the sensor will be imprinted at a desired location.

10. The printer of claim 1 wherein the first print head and the second print head are inkjet print heads, and further comprising at least one inkjet printer ink supply and control unit which supplies the first print head and the second print head with material to be applied to the straw to form the markings thereon.

11. The printer of claim 1 further comprising a controller which controls the first print head to imprint markings which are upright with respect to the housing and which controls the second print head to imprint markings which are inverted with respect to the printer housing, such that the two lines of markings thus imprinted will comprise characters which are readable as two lines of markings with similar orientation on the imprinted straw.

12. The printer of claim 1 wherein the straw support bridge is releaseably connected to the housing, and further comprising an alternative support bridge which is configured to support and guide straws of a larger diameter than those supported and guided by the straw support bridge, wherein the alternative support bridge may be substituted for the straw support bridge to convert the printer for imprinting multiple lines of markings upon straws of a larger diameter.

13. The printer of claim 1 wherein the belt drive system comprises two parallel continuous looped drive belts, and wherein the continuous looped drive belts have portions upstream of the straw support bridge which define a straw infeed section which advances a straw into the support bridge, and wherein the continuous looped drive belts have portions downstream of the straw support bridge which define a straw outfeed section which extracts a straw from the support bridge.

14. The printer of claim 13 further comprising;

a) a first infeed pulley positioned upstream of the support bridge;

b) a second infeed pulley positioned downstream of the first infeed pulley, wherein the straw infeed section of the parallel drive belts is defined between the first infeed pulley and the second infeed pulley;

c) a first outfeed pulley positioned downstream of the second infeed pulley; and d) a second outfeed pulley positioned downstream of the first infeed pulley, wherein the straw outfeed section of the parallel drive belts is defined between the first outfeed pulley and the second infeed pulley.

15. The printer of claim 14 further comprising a relief pulley positioned beneath the straw support bridge which engages the parallel drive belts between the second infeed pulley and the first outfeed pulley to thereby direct the parallel drive belts away from the straw support bridge.

16. A printer for printing multiple lines of markings on a straw for containing products therein, the printer comprising:

a) a housing;

b) a first noncontact print head mounted to the housing;

c) a second noncontact print head mounted to the housing facing toward the first noncontact print head;

d) a drive system having means for supporting and advancing a straw;

e) a straw support bridge mounted to the housing and which receives a straw from the drive system means for supporting and advancing, the drive system advancing said straw through the support bridge without contacting said straw within the support bridge;

f) portions of the support bridge defining an unobstructed window positioned between the first print head and the second print head, such that a first line of markings may be imprinted on one side of said straw by the first print head and a second line of markings may be simultaneously imprinted on said straw by the second print head while the straw is advanced by the drive system through the support bridge window; and g) portions of the support bridge supporting said straw to align it for passage through the straw window and to deliver it into engagement with the drive system supporting and advancing means after the straw has been imprinted by the first print head and the second print head.

17. The printer of claim 16 wherein the straw support bridge has a portion defining an infeed tunnel which is aligned with an infeed portion of the drive system, wherein a straw is driven into the infeed tunnel by the drive system, and wherein the straw is discharged from the infeed tunnel into the support bridge window, and wherein the straw is not in contact with any structure where it passes through the support bridge window.

18. The printer of claim 17 wherein the straw support bridge has portions defining a slot having a horizontal support surface downstream of the window which is aligned with the infeed tunnel, wherein the imprinted straw is supported on the support surface without sideward contact to minimize disturbance of the imprinted straw surfaces within the bridge.

19. The printer of claim 17 wherein the support bridge is comprised of two connected plates, wherein each plate has portions defining a channel therein, such that the channels are aligned in the support bridge to form the infeed tunnel.

20. The printer of claim 16 further comprising a straw hopper attached to the housing and disposed above the drive system supporting and advancing means upstream of the support bridge, wherein the hopper contains a plurality of straws, and wherein the hopper is controllable to dispense individual straws onto the supporting and advancing means for advancement to the support bridge for printing upon said straws.

21. The printer of claim 16 further comprising a sensor mounted to the housing upstream of the straw support bridge, wherein the sensor is configured to detect the presence of a straw on the drive system.

22. The printer of claim 21 further comprising a controller which receives signals from the sensor indicating the presence of a straw on the drive system, wherein the controller sends instructions to the first print head and the second print head to initiate printing at a selected time such that the straw which has been detected by the sensor will be imprinted at a desired location.

23. The printer of claim 16 wherein the first print head and the second print head are inkjet print heads, and further comprising at least one inkjet printer ink supply and control unit which supplies the first print head and the second print head with material to be applied to the straw to form the markings thereon.

24. The printer of claim 16 further comprising a controller which controls the first print head to imprint markings which are upright with respect to the housing and which controls the second print head to imprint markings which are inverted with respect to the printer housing, such that the two lines of markings thus imprinted will comprise characters which are readable as two lines of markings with similar orientation on the imprinted straw.

25. The printer of claim 16 wherein the straw support bridge is releaseably connected to the housing, and further comprising an alternative support bridge which is configured to support and guide straws of a larger diameter than those supported and guided by the straw support bridge, wherein the alternative support bridge may be substituted for the straw support bridge to convert the printer for imprinting multiple lines of markings upon straws of a larger diameter.

* * * * *